United States Patent [19]

Merkle, Jr.

[11] 4,073,243

[45] Feb. 14, 1978

[54] INDUSTRIAL FURNACE ROOF ASSEMBLY AND COMPONENTS THEREOF

[75] Inventor: Frank P. Merkle, Jr., Barrington, Ill.

[73] Assignee: Merkle & Associates, Inc., Palatine, Ill.

[21] Appl. No.: 746,322

[22] Filed: Dec. 1, 1976

[51] Int. Cl.[2] ..... F23M 5/04

[52] U.S. Cl. ..... 110/99 R; 110/1 A; 432/247; 52/509; 248/340

[58] Field of Search ..... 110/1 R, 1 A, 99 R, 110/99 A; 432/247; 52/506, 509, 511, 513; 248/340

[56] References Cited

U.S. PATENT DOCUMENTS

| | | | |
|---|---|---|---|
| 3,260,228 | 7/1966 | Lingl | 110/99 |
| 3,589,316 | 6/1971 | Longenecker | 110/99 |
| 3,824,936 | 7/1974 | Merkle, Jr. | 110/99 |
| 3,832,959 | 9/1974 | Longenecker | 110/1 |

*Primary Examiner*—Kenneth W. Sprague
*Attorney, Agent, or Firm*—Thomas W. Speckman

[57] ABSTRACT

A high temperature industrial furnace roof assembly wherein two refractory bricks are held in adjacent position by suitable securement and have a hanger rod extending from the assembly to suspend the roof assembly from a support structure in desired position in a furnace roof. The hanger rod is maintained in locked position when the weight of the roof assembly is placed upon it. The hanger rod may be depressed into the refractory bricks permitting free rotation of the hanger rod with respect to the hanger and brick assembly and locked into desired position at 90° increments by a force applied to the hanger rod in a direction away from the brick assembly. The roof assembly of this invention is particularly desirable for furnace roof repair and provides for easy installation in operating high temperature furnaces permitting the long axes of the repair assembly to be changed on the jobsite by rotation of the hanger.

12 Claims, 2 Drawing Figures

INDUSTRIAL FURNACE ROOF ASSEMBLY AND COMPONENTS THEREOF

This invention relates to refractory assemblies and components thereof for use in industrial furnace roofs. More particularly, this invention relates to roof assemblies and components particularly suitable for repairing suspended refractory brick roofs.

Refractory bricks are used in roof construction of high temperature industrial furnaces such as reverberatory furnaces. In furnace roof construction the refractory bricks are suspended from a support structure which may be from several inches to about 2 feet above the brick roof. The refractory bricks are suspended from the support structure by various suspending means, such as metallic hangers which hold the bricks at one end and hook over the support structure at the other end. Reverberatory furnaces are frequently operated for many years without shutdown. However, the life of the suspended roof which is usually constructed from refractories is from 6 months to 3 years. This makes patching the roof during furnace operation necessary. Some roof refractory structures are panelized so that entire panels may be removed and replaced, or individual pairs of bricks in the panel may be patched by use of assemblies of this invention. In roofs which are not panelized, the roof is constructed by placement of individual or pairs of bricks. The assembly of this invention may be used in original roof construction. The assemblies of this invention may also be used in repair of non-panelized furnace roofs.

The refractory bricks used in high temperature furnace construction have a rectangular cross section. Normally, in patching refractory roofs, two bricks are assembled with a hanger supporting both bricks in the patching assembly. The cross section of the patching assembly is rectangular, normally occupying a space of 4½ by 7 inches. When patching the refractory roof, the opening for the patch assembly may have a long dimension which runs parallel to the longitudinal center line of the furnace or at right angles to it, depending upon the shape of the hole to be patched. The support structure, whether panelized construction is used or individual pairs of bricks are used, normally runs at right angles to the center line of the furnace.

Most patching or repair assemblies previously available, due to the opening being greater in one dimension than the other, require use of two types of assemblies. Since the plane of the hook of the hanger and the long dimension of the brick patching assembly were not rotatable with respect to each other, it has been necessary to provide one assembly with a hanger hook for attachment to the support structure parallel to the long dimension of the patch assembly and one with the hanger hook at right angles to the long dimension of the patch assembly. Therefore, it has been necessary to provide more than the required number of patch assemblies at the jobsite since it is not usually known until engaging in the repair, which way the patch assembly will be introduced into the furnace. One attempt to overcome this disadvantage and to utilize patch assemblies having a hanger with a hook which may be used in both directions has been to provide a hanger with a mushroom-shaped head loosely fitting in the refractory brick recess, thereby allowing the hanger hook to rotate 360° with respect to the bricks. This eliminates the inventory problem, but creates serious disadvantages in use since the refractory is free to rotate on the end of the hanger and makes it difficult to insert the patch into the hole in the hot furnace roof, especially in cases where the patch must be inserted at an angle. Many of the same problems arise in new furnace construction.

It is an object of the present invention to provide an industrial furnace roof assembly which overcomes the above disadvantages.

It is another object of this invention to provide a single industrial furnace roof assembly which may be readily installed with its long dimension either parallel to or at right angles to the center line of an operating industrial furnace suspended roof.

It is yet another object of this invention to provide a high temperature refractory roof assembly having a hanger which may be rotated 90° with respect to the refractories.

Another object of this invention is to provide a refractory roof assembly having a hanger which may be locked at 90° intervals in non-rotatable relationship with the refractories.

Still other objects of this invention will readily present themselves upon reference to the drawings showing preferred embodiments wherein.

Figure 1:
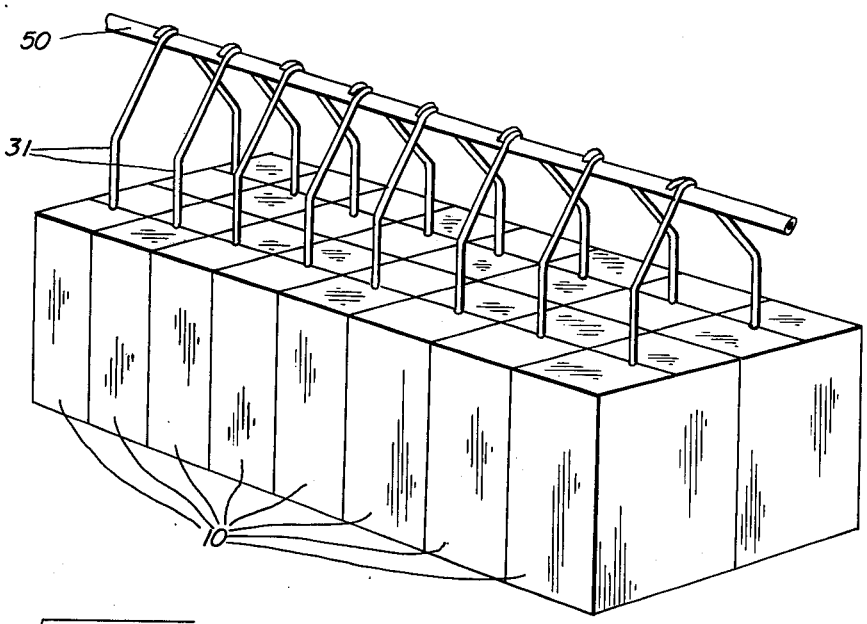
FIG. 1 is a perspective view of a group of roof assemblies according to one embodiment of this invention suspended in a furnace roof.

FIG. 1 shows 16 adjacent roof assemblies 10 of this invention as they are suspended by hanger rods 31 from support structure 50 in an industrial furnace roof.

FIGS. 2 through 8 show assembled roof assembly 10 comprising refractory bricks 11 and 12, hanger assembly 30 comprising hanger rod 31 and hanger 40 and roof assembly casing 20.

The refractory brick may be produced from any suitable material to provide the desired thermal and physical properties. Typical bricks suitable for purposes of this invention are basic refractories of magnesia and chrome ores, alumina-clay refractories, and silica refractories. The refractory brick may be made in any desired shape and size, typically the cross section of the brick is 3½ × 4½ inches and the bricks are typically 12 to 15 inches deep. The refractory brick has adjacent face 13 for tight abutment to a matching adjacent face of a second refractory brick. Extending inwardly from adjacent face 13 is a hanger recess 15 and beneath hanger recess 15 is locking means well 16. Hanger rod hole 14 extends from said recess to the top of the brick. In the assembled position two bricks are held with their adjacent faces abutting by casing 20. In the assembled position the hanger recess of one brick opposes the hanger recess of the other brick. The figures show a preferred embodiment wherein the locking means well and hanger rod hole are symmetrically in each of the two bricks, each of the two bricks having generally opposing hanger recesses for support of the bricks. The roof assembly is more easily handled when the hanger rod is over the center of gravity of the assembly.

Hanger assembly 30 comprises hanger rod 31 and hanger 40. Hanger rod 31 has locking means 32 at one end and hook 35 at the other end. Hanger rod 31 is of suitable vertical height so that when hook 35 engages the furnace roof support means, the repair assembly is in the desired position in the furnace roof. Hanger rod 31 has shaft portion 33 suitably sized to fit through hanger rod hole 14 and oblique shaft portion 34 terminating in hook 35. Oblique shaft portion is of suitable length and angle to place hook 35 in the desired position with respect to the furnace roof support means. The supports of the roof support means over which the hanger hooks usually are located above the junction of pairs of two refractory bricks to render insertion and removal of the bricks easier. This is the reason for the oblique shaft portion.

Hanger 40 has hanger rod hole 43 of suitable size so that hanger 40 may be slipped over the hook end of the hanger rod and rotates freely about hanger rod shaft portion 33 above the locking means when in the non-locked position. Hanger 40 has refractory engaging projection 41 and opposing refractory engaging projection 42 of suitable size for fitting into hanger recess 15 of the refractory brick. Hanger 40 has locking engagement means for locking hanger 40 in 90° increments with respect to hanger rod 31. FIGS. 4–8 show one embodiment of locking engagement means as locking lug 44 and opposing locking lug 45 adjacent the bottom of hanger rod hole 43. The locking lugs on the hanger are of suitable size and spacing to lock hanger rod 31 in non-rotating position when the locking lugs engage locking head 32 at the end of hanger rod 31.

Figure 9:
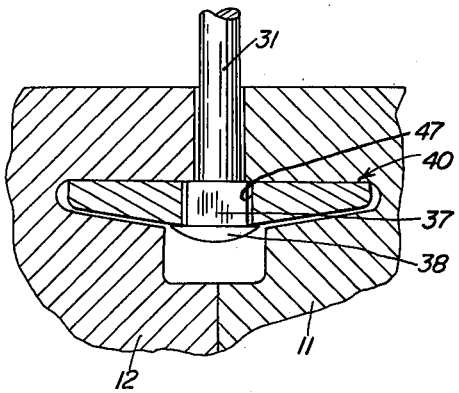
FIG. 9 shows another embodiment of a hanger rod locking means and hanger locking engagement means in a roof assembly of this invention.
Figure 7:
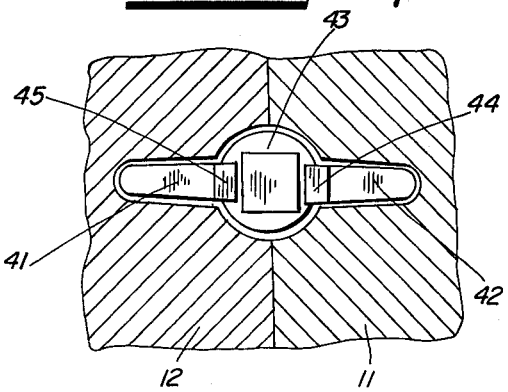
FIG. 7 is a partial sectional view showing the bottom of the hanger.
Figure 8:
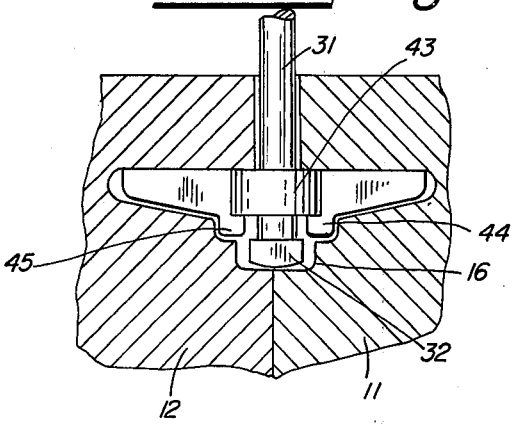
FIG. 8 is the same view as FIG. 4 showing the hanger rod depressed for rotational movement.

Any suitable locking means at the end of hanger rod 30 and locking engagement means may be used which provide firm non-rotational movement of the hanger rod with respect to the hanger at 90° increments when the hanger rod has a force away from the bricks applied to it. The locking and locking engagement means must provide rotation of the hanger rod with respect to the hanger when a force toward the bricks is applied to the hanger rod and the locking means at the end of rod 30 shown as locking head 32 is pushed into locking means well 16 as shown in FIG. 8 disengaging the locking means. Another embodiment providing such locking and unlocking is shown in FIG. 9. The hanger shown in FIG. 9 does not have locking lugs, but has square hole 47 which locks square shaft portion 37 of hanger rod 31. Hanger rod 31 has head 38 to hold hanger 40. In this embodiment, the locking means of hanger rod 31 is similar to the head of a carriage bolt.

It is seen that the roof assembly may be readily fabricated at the jobsite or may be fabricated at a central fabrication center and transported to the jobsite as a unit. The roof assembly is assembled by placing the hanger on the hanger rod and placing two refractory bricks with adjacent faces 13 together and the opposing refractory engaging projections of the hanger within the opposing hanger recesses of the two refractory bricks. Roof assembly casing means 20 can then be slid over the end of the refractory bricks or wrapped around the refractory bricks to hold the roof assembly in firm assembled position. Hanger rod 31 may be readily rotated with respect to the roof assembly by depressing the hanger rod so that locking means 32 disengages locking engagement means 44 and 45 and extends into locking means well 16 permitting free rotation of the hanger rod as shown in FIG. 8. Hanger rod 31 may be locked into desired position at 90° rotational increments by pulling hanger rod 31 outwardly from the refractories thereby engaging locking means 32 and locking engagement 44 and 45.

Figure 2:
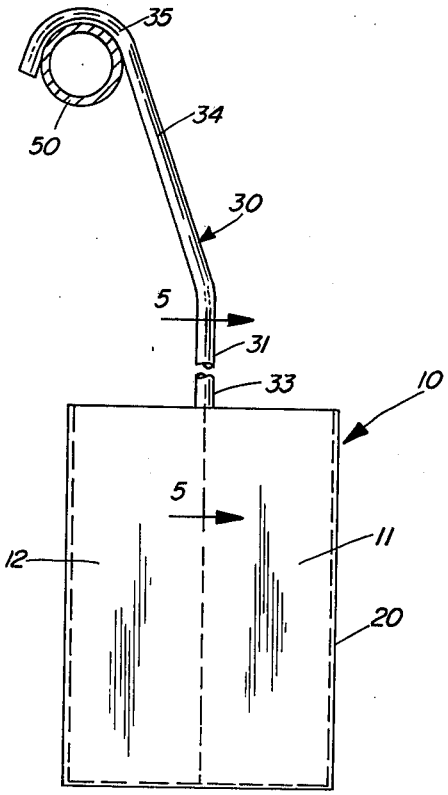
FIG. 2 is a side view of one repair assembly according to this invention.
Figure 3:
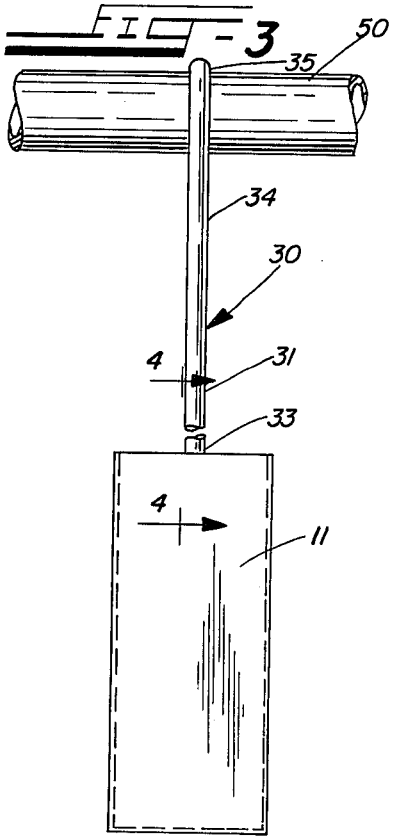
FIG. 3 is an end view of the repair assembly shown in FIG. 2.
Figure 4:
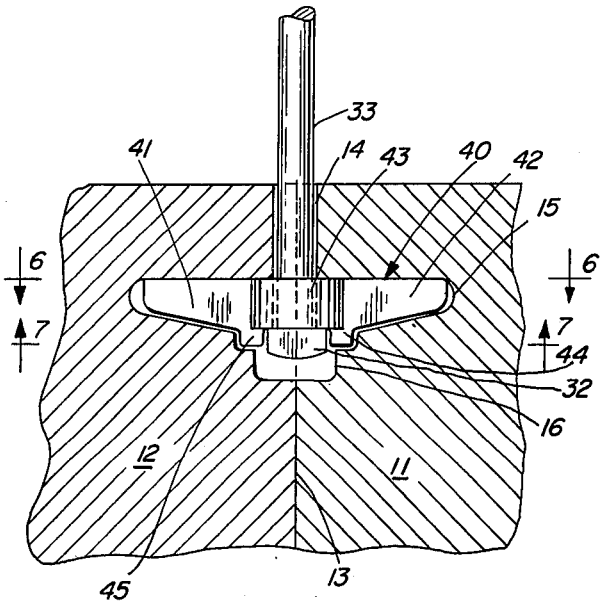
FIG. 4 is a partial sectional view as shown in FIG. 3 showing the hanger and hanger rod assembly in relation to the refractory bricks.
Figure 5:
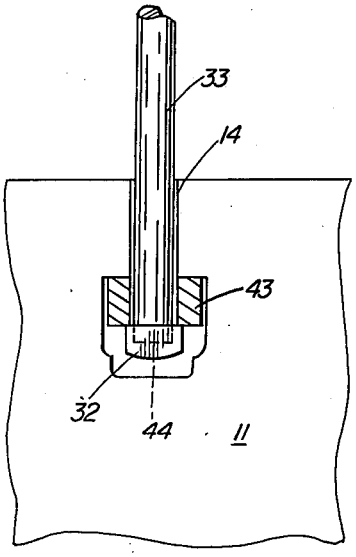
FIG. 5 is a partial sectional view as shown in FIG. 2 showing the hanger and hanger rod assembly in relation to a refractory brick.
Figure 6:
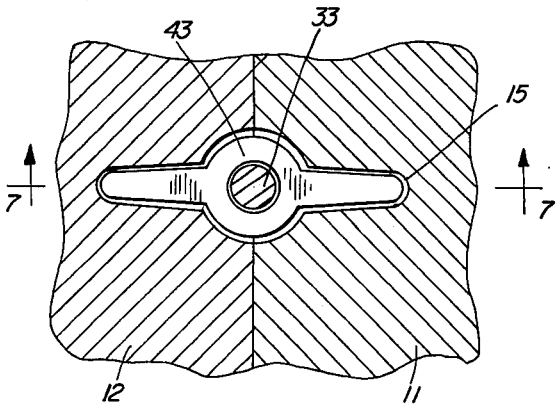
FIG. 6 is a partial sectional view showing the top of the hanger.

While the above description and the figures show roof assembly casing 20 to be a solid can surrounding the assembly, other securement means may be used. A full cold rolled steel can encasing the roof assembly, as shown in FIGS. 2 and 3, is advantageous since it also affords some heat protection upon insertion of the cold bricks into the hot furnace roof. However, the assembly can be secured with other securement means such as metal strapping, wire, adhesives, or fiberglass tape.

The hanger rod and hanger may be fabricated from the same or different materials as desired for structural strength and heat resistance. For many applications, it is desired that the hanger rod be cold rolled steel or alloy thereof and the hanger cast iron or heat resistant alloy thereof.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A high temperature industrial furnace roof assembly comprising:

two refractory bricks having adjacent faces, opposing hanger recesses, locking means well beneath said recesses, hanger rod hole extending from said recesses to the exterior of the top of said assembly, said refractory bricks held in adjacent position by securement means;

a hanger rod having locking means at one end and a hook at the other end;

a hanger having opposed refractory engaging projections adapted to fit said hanger recesses, a hanger rod hole allowing free rotation about said hanger rod one end above said locking means and locking engagement means which when engaged with said locking means prevents rotation of said hanger rod in relation to said hanger at 90° increments and provides that depression of said one end of said hanger rod into said locking means well permits rotation of said hanger rod with respect to said hanger.

2. The high temperature industrial furnace roof assembly of claim 1 wherein said locking means at one end of said hanger rod is a square head.

3. The high temperature industrial furnace roof assembly of claim 1 wherein said locking means at one end is a square shaft portion of said hanger rod and said hanger rod has a head portion below and larger than said square shaft portion.

4. The high temperature industrial furnace roof assembly of claim 1 wherein said locking engagement means are two opposing lugs extending beneath said hanger rod hole in said hanger.

5. The high temperature industrial furnace roof assembly of claim 1 wherein said locking engagement means is a square cross section shaped hanger rod hole.

6. The high temperature industrial furnace roof assembly of claim 1 wherein said hanger rod extends obliquely to said hook from above said refractory bricks.

7. The high temperature industrial furnace roof assembly of claim 1 wherein said securement means is a cold rolled steel can encasing the sides and bottom of said repair assembly.

8. The high temperature industrial furnace roof assembly of claim 1 wherein said securement means are metal strapping.

9. The high temperature industrial furnace roof assembly of claim 1 wherein said securement means are wire.

10. The high temperature industrial furnace roof assembly of claim 1 wherein said securement means are fiberglass tape.

11. A hanger assembly for use in high temperature industrial furnace roofs comprising a hanger rod having locking means at one end and a hook at the other end; a hanger having opposed refractory engaging projections adapted to fit hanger recesses in adjacent refractory bricks, a hanger rod hole allowing free rotation about said hanger rod one end above said locking means and locking engagement means which when engaged with said locking means prevents rotation of said hanger rod in relation to said hanger at 90° increments and provides that depression of said one end of said hanger rod disengages said locking means and permits rotation of said hanger rod with respect to said hanger.

12. The hanger assembly of claim 11 wherein said locking means is a square head and said locking engagement means are two opposing lugs extending beneath said hanger rod hole.

* * * * *